US007228853B1

(12) United States Patent
Skinner et al.

(10) Patent No.: US 7,228,853 B1
(45) Date of Patent: Jun. 12, 2007

(54) IGNITION APPARATUS HAVING CONDUCTIVE PLASTIC IGNITION TERMINAL AND FIELD SMOOTHER

(75) Inventors: Albert Anthony Skinner, El Paso, TX (US); Colin Hamer, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/293,959

(22) Filed: Dec. 5, 2005

(51) Int. Cl.
*F02P 1/00* (2006.01)
*F02P 3/02* (2006.01)

(52) U.S. Cl. ..... 123/634; 123/146.5 R

(58) Field of Classification Search ..... 123/143 R, 123/146.5 R, 169 R, 634, 635
See application file for complete search history.

(56) References Cited

U.S. PATENT DOCUMENTS 3,886,818 A * 6/1975 Wurst ..... 477/163
4,078,534 A * 3/1978 Mayer ..... 123/633
5,254,968 A * 10/1993 Zirnheld ..... 338/50
6,522,232 B2 * 2/2003 Paul et al. ..... 336/96
6,556,118 B1 * 4/2003 Skinner ..... 336/182
6,679,235 B1 1/2004 Skinner et al.
6,679,236 B2 * 1/2004 Skinner et al. ..... 123/634
6,724,289 B2 4/2004 Moga et al.
2003/0034865 A1 * 2/2003 Moga et al. ..... 336/90
2003/0037745 A1 * 2/2003 Moga et al. ..... 123/143 C
2003/0197297 A1 * 10/2003 Berk et al. ..... 264/40.6
2004/0104796 A1 * 6/2004 Kawai et al. ..... 336/90

* cited by examiner

*Primary Examiner*—John T. Kwon
(74) *Attorney, Agent, or Firm*—Paul L. Marshall

(57) ABSTRACT

An ignition apparatus includes a high voltage (HV) terminal to which a high voltage end of the secondary winding is attached. The ignition apparatus further includes an electrically conductive cup configured to surround the high voltage terminal when the secondary winding spool is inserted in the case. The high voltage terminal has one end that comes into engagement with an inner annular surface of the cup. Electromagnetic interference suppression is provided by a resistor disposed between the cup and a high voltage connector assembly that connects to a spark plug. The resistor is formed of electrically conductive plastic material.

12 Claims, 3 Drawing Sheets

IGNITION APPARATUS HAVING CONDUCTIVE PLASTIC IGNITION TERMINAL AND FIELD SMOOTHER

BACKGROUND OF THE INVENTION

1. Technical Field

The present invention relates generally to an ignition apparatus for developing a spark firing voltage that is applied to one or more spark plugs of an internal combustion engine.

2. Discussion of the Background Art

Ignition coils are known for use in connection with an internal combustion engine such as an automobile engine, and which include a primary winding, a secondary winding, and a magnetic circuit. The magnetic circuit conventionally may comprise a cylindrical-shaped, central core extending along an axis, located radially inwardly of the primary and secondary windings and magnetically coupled thereto. The components are contained in a case formed of electrical insulating material, with an outer core or shield located outside of the case. One end of the secondary winding is conventionally configured to produce a relatively high voltage when a primary current through the primary winding is interrupted. In a common configuration, insulating resin or the like is introduced into the gap between the secondary winding and the case for insulating purposes. The high voltage end is coupled to a spark plug, as known, that is arranged to generate a discharge spark responsive to the high voltage. It is further known to provide relatively slender ignition coil configuration that is adapted for mounting directly above the spark plug—commonly referred to as a "pencil" coil.

U.S. Pat. No. 6,724,289 entitled "IGNITION APPARATUS HAVING FEATURE FOR SHIELDING THE HV TERMINAL" issued to Moga et al. disclose a pencil coil type ignition apparatus that includes an electrically conductive cup configured to engage and surround the high voltage terminal, thereby suppressing the electromagnetic field concentration at the high voltage terminal. Moga et al. further disclose a resistor between such cup and a spring (which connects to the spark plug). The resistor is provided for suppressing electromagnetic interference. In this regard, Moga et al. further disclose a second cup on the lower end of the resistor in order to provide, among other things, an interface to the spring. However, the arrangement in Moga et al. comprises multiple, individual pieces (i.e., the resistor and the second cup) in order to mate to the spring, increasing somewhat the complexity of the apparatus. In addition, a predetermined amount or volume of the insulating resin is used, which has a certain cost. It would be desirable to reduce this cost.

Accordingly, there is a need for an improved ignition apparatus that minimizes or eliminates one or more of the shortcomings as set forth above.

SUMMARY OF THE INVENTION

An object of the present invention is to improve upon one or more of the shortcomings set forth above. An ignition apparatus according to the present invention overcomes the shortcomings of a conventional ignition apparatus by including, among other things, a conductive cup and a resistive element where the resistive element is formed of electrically conductive plastic material having a predetermined electrical resistance. The resistive element includes a first axial end extending from the cup and a second axial end opposite the first axial end. Significantly, the second axial end is configured (e.g., in size and shape) to electrically engage a high voltage connector assembly (e.g., a spring) for connection to a spark plug. Through the foregoing, the resistor and secondary cup (for interface to the spring) of the prior art can be eliminated in favor of a single component performing both functions.

In a first embodiment, the cup is formed of metal and includes an annular aperture configured to receive the first axial end of the resistive element.

In a second embodiment, the cup is also formed of electrically conductive plastic material wherein the cup and the resistive element are unitary.

The resistive element may be generally cylindrical in shape having a first diameter and a length. The predetermined resistance has a value that is a function of the first diameter and the length. Accordingly, the predetermined resistance may be varied by adjusting the first diameter and length.

Where the cup and resistive element are unitary, the cup includes an opening having a second diameter configured in size and shape to fit over a secondary winding spool.

The present invention provides the advantage of (i) simplifying construction by reducing components and related operations; and (ii) reducing the amount of insulating resin used by providing an increased closed volume within the case of the ignition apparatus. These points reduce cost.

BRIEF DESCRIPTION OF THE DRAWINGS

The present invention will now be described by way of example, with reference to the accompanying drawings.

DETAILED DESCRIPTION OF THE PREFERRED EMBODIMENTS

Figure 1:
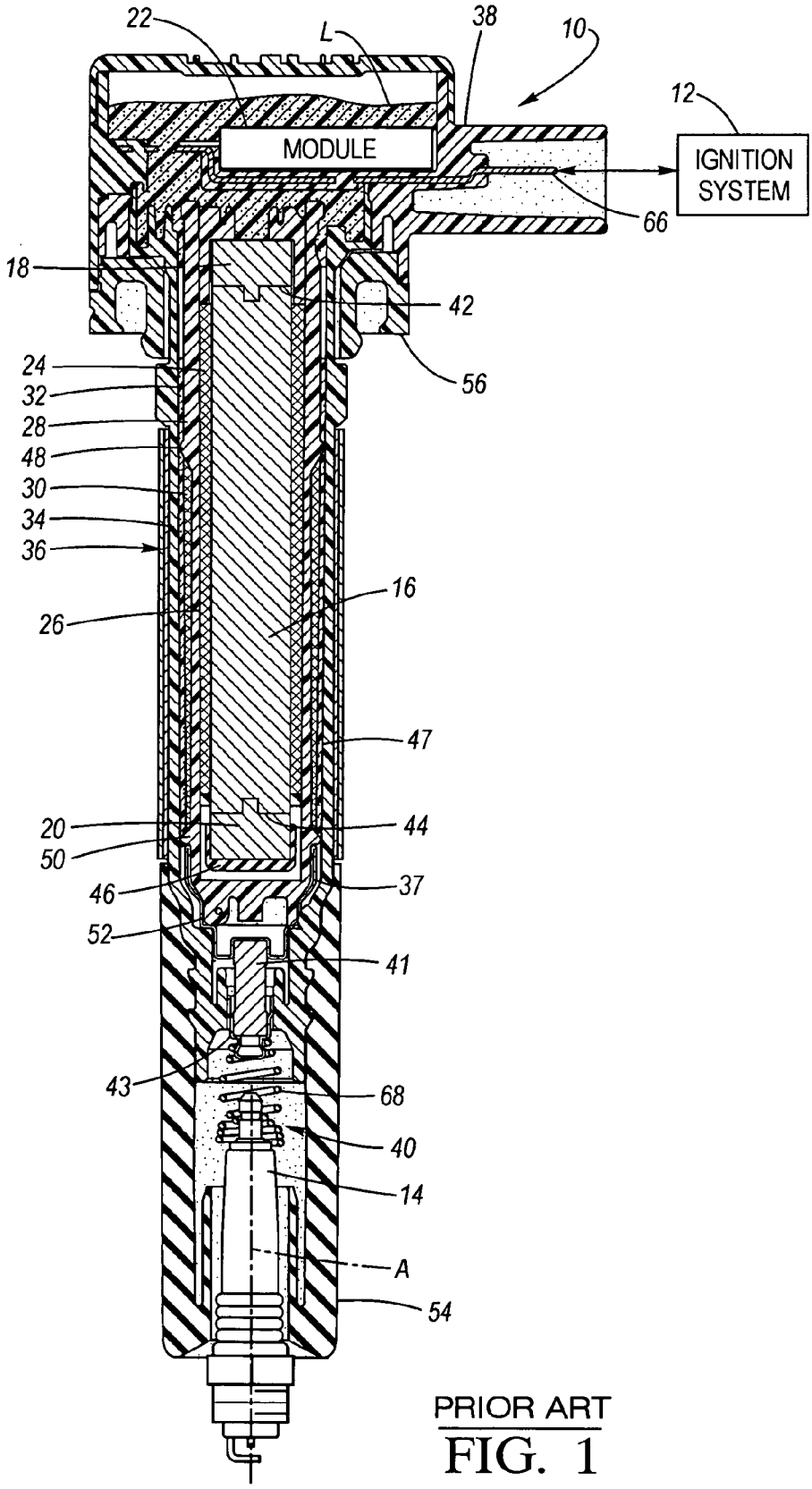
PRIOR ART FIG. 1
FIG. 1 is a simplified cross-sectional view of a conventional ignition apparatus.

Referring now to the drawings wherein like reference numerals are used to identify identical components in the various views, FIG. 1 is a simplified, cross-section view of a conventional ignition apparatus or coil 10, as disclosed in U.S. Pat. No. 6,724,289 entitled "IGNITION APPARATUS HAVING FEATURE FOR SHIELDING THE HV TERMINAL" issued to Moga et al., hereby incorporated by reference in its entirety. As is generally known, ignition apparatus 10 may be coupled to, for example, an ignition system 12, which contains primary energization circuitry for controlling the charging and discharging of ignition apparatus 10. Further, the relatively high voltage produced by ignition apparatus 10 is provided to a spark plug 14 for producing a spark across a spark gap thereof, which may be employed to initiate combustion in a combustion chamber of an engine. Ignition system 12 and spark plug 14 perform conventional functions well known to those of ordinary skill in the art.

Ignition apparatus 10 is adapted for installation to a conventional internal combustion engine through a spark plug well onto a high-voltage terminal of spark plug 14, which may be retained by a threaded engagement with a spark plug opening into the above-described combustion cylinder. The engine may provide power for locomotion of a self-propelled vehicle, such as an automotive vehicle.

FIG. 1 further shows a core 16, an optional first magnet 18, an optional second magnet 20, an electrical module 22, a primary winding 24, a first layer of insulating resin (encapsulant) such as an epoxy potting material layer 26, a secondary winding spool 28, a secondary winding 30, a second layer 32 of encapsulant such as epoxy potting material, a case 34, a shield assembly 36, a first electrically conductive cup 37, a low-voltage (LV) connector body 38, and a high-voltage (HV) connector assembly 40. Core 16 includes a top end 42 and a bottom end 44. Connector assembly 40 may include an inductive resistor 41, a second conductive cup 43, and a spring 68. FIG. 1 further shows a rubber buffer cup 46, a winding surface 47 of spool 28, annular flange portions 48, 50, a high voltage (HV) secondary terminal 52, a boot 54, and a seal member 56.

It should be appreciated that the known arrangement shown in FIG. 1 employs two separate elements, namely, a resistor 41 and second conductive cup 43, in combination, in order to mate the spark voltage through to spring 68, for ultimate connection to spark plug 14. The present invention may, in an exemplary embodiment, employ substantially the same structure as shown in FIG. 1, with the exception of a substitution of a new component in place of resistor 41 and cup 43.

Figure 2:
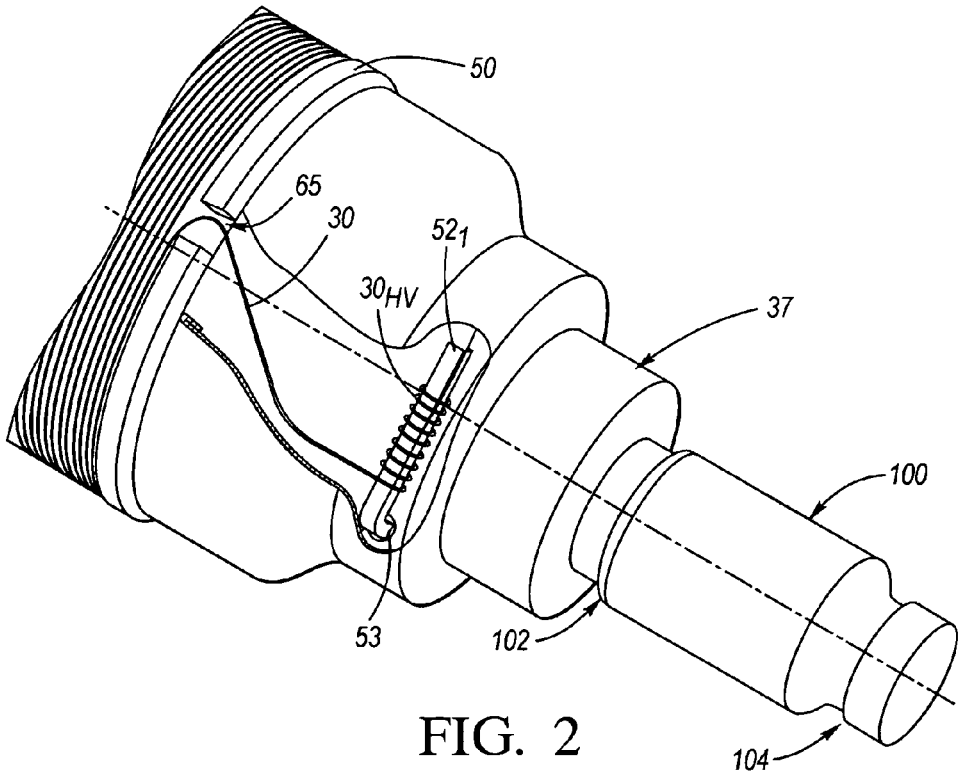
FIG. 2 is a simplified perspective view of an apparatus in accordance with a first embodiment of the present invention having a resistive element formed of conductive plastic material.

FIG. 2 is a simplified perspective view of a first embodiment of an ignition apparatus 10 according to the invention, including a resistive element 100 formed of an electrically conductive plastic material. Resistive element 100 includes a first axial end 102 and a second axial end 104 opposite the first axial end 102. The configuration of resistive element 100 is such that it exhibits a predetermined electrical resistance suitable for suppression of electromagnetic interference. With respect to such electrical characteristics, element 100 may have the same such characteristics as resistor 41 in FIG. 1. Further, since element 100 carries the spark voltage, it is formed so that all curves/transitions and outer surfaces are smooth and of relatively large radii so as to reduce any electric field concentration.

Resistive element 100 may comprise polymers suitable for injection molding, such as polyethylene terephthalate (PET), polybutylene terephthalate (PBT) or various nylon materials (e.g., nylon 6, nylon 66, nylon 12). These polymers are available with additives that can decrease their resistivity to a range surrounding about 100 ohm-cm. In one embodiment, the selected material is a nylon (glass reinforced, conductive polyamide 66) commercially available under the trade name ZYTEL® CDV595 BK409 from E.I. du Pont de Nemours and Company, Wilmington, Del. U.S.A., which has a resistivity of about 1 ohm-cm in its original state. This ZYTEL CDV595 BK409 material can be blended with standard ZYTEL® (non-conductive) to yield a material in the 100 ohm-cm range of resistivity. In a preferred embodiment, materials for use for element 100 have a resistivity in the range of between about 10 and 1000 ohm-cm. Within this range, it is practical to form a resistance in the range of about 1000 ohms $$\left(i.e., \text{Resistance} = (\text{resistivity}) * \frac{\text{length}}{\text{area}}\right).$$

It should be appreciated that variations are possible and yet remain within the spirit and scope of the invention.

Cup 37, in the first embodiment of the invention, is configured in size and shape to be pressed or molded onto a lower axial portion of spool 28. Since cup 37 also carries the spark voltage, it is manufactured in such a way so as to not have any sharp edges, burrs, or the like so as to avoid electric field concentrations. These manufacturing approaches include but are not limited to machining and stamping, coupled with, for example, a vibratory finishing. FIG. 2 shows the cup 37 in an installed position.

Secondary winding 30 exits the winding bay through an axially extending passage 65. In the illustrated embodiment, terminal 52 comprises a wire that is square shaped in cross-sectional. Terminal 52 may be inserted in a bore 53 formed in spool 28. A high voltage end of winding 30, designated $\mathbf{30}_{HV}$, is terminated on end $\mathbf{52}_1$ of terminal 52, for example, via multiple turns, accompanied by a conventional soldering process.

The cup 37 is in electrical contact with the high voltage terminal 52, and is therefore at the same electrical potential or voltage. Significantly, the cup has annular sidewalls that extend axially up to the lower winding flange 50. Accordingly, any electric field concentration is reduced.

With continued reference to FIG. 2, first axial end 102 of element 100 is configured to press fit in an annular aperture 62 (best shown in FIG. 4) of the cup 37. Second axial end 104 is configured to electrically engage a high voltage connector assembly 40, for example, a spring 68 (best shown in FIG. 4).

It should be understood that the present invention improves upon the conventional art by (i) reducing the number of discrete components, particularly by combining the resistor 41 and secondary cup 43 of FIG. 1, thereby simplifying construction and related operations as well as improving reliability; and (ii) reducing the amount of insulating resin (e.g., epoxy potting material) needed in ignition apparatus 10 by presenting a corresponding increase in the closed, displacing volume of resistive element 100, relative to the conventional combination of resistor 41/cup 43. These points reduce cost.

Figure 4:
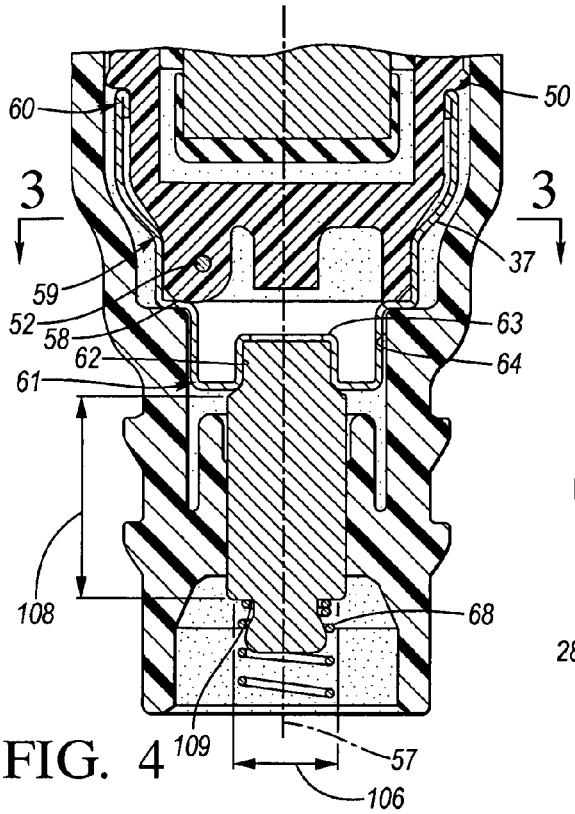
FIG. 4 is a simplified cross-sectional view showing the resistive element in accordance with the first embodiment of the invention.
Figure 3:
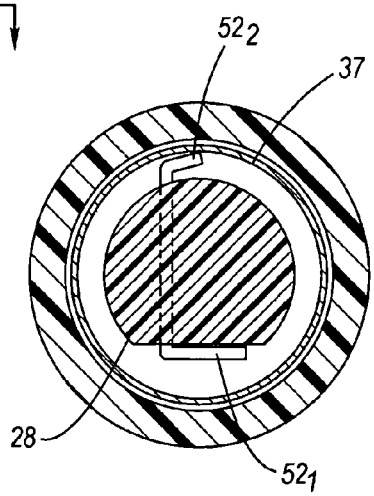
FIG. 3 is a simplified cross-sectional view taken substantially along lines 3-3 in FIG. 4.

FIG. 3 is a cross-sectional view of apparatus 10 taken substantially along lines 3-3 in FIG. 4. When secondary spool 28 is inserted and pressed longitudinally downwardly into case 34, terminal 52 will go down into an interior portion of cup 37. A first end $\mathbf{52}_1$, is bent over after the high voltage $\mathbf{30}_{HV}$ is terminated thereto. The second end $\mathbf{52}_2$ is also bent over; however, the shape and dimensions of spool 28 and cup 37 are selected so that end $\mathbf{52}_2$ engages cup 37 when cup 37 is placed over the bottom of spool 28. The shape of spool 28 and dimensions are further selected so that end $\mathbf{52}_1$ does not touch cup 37. Terminal end $\mathbf{52}_2$ and cup 37 will be in positive electrical contact. Because cup 37 is at substantially the same voltage potential as high voltage terminal 52, and cup 37 surrounds terminal 52, there will be a substantially reduced or eliminated electric field concentration at terminal 52. Moreover, since cup 37 has sidewalls 59 that extend axially up to flange 50 (best shown in FIG. 4), the wire exiting the secondary winding bay is also surrounded. This has the advantage of reducing any electric field concentrations surrounding the thin wire, as disclosed in U.S. Pat. No. 6,724,289 entitled "IGNITION APPARATUS HAVING FEATURE FOR SHIELDING THE HV TERMINAL".

FIG. 4 shows another cross-sectional view of the first embodiment of the present invention, which includes resistive element 100. Resistive element 100 further includes a main diameter 106 and a length 108. The predetermined resistance of element 100 has a value that is a function of both diameter 106 and 108. Accordingly, the predetermined resistance can be varied by adjusting either or both diameter 106 and length 108.

As also shown, first axial end 102 of resistive element 100 is seated and engaged in annular aperture 62. The second axial end 104 may be configured to engage spring 68 thus eliminating the need for a separate component to provide a suitable mating structure for spring 68 (e.g., like cup 43 performs in FIG. 1). In this regard, the second axial end is annular and has a diameter that is reduced, relative to the main diameter 106, such that a shoulder 109 is formed. Shoulder 109 provides a suitable surface to be contacted by an upper end of spring 68.

Figure 5:
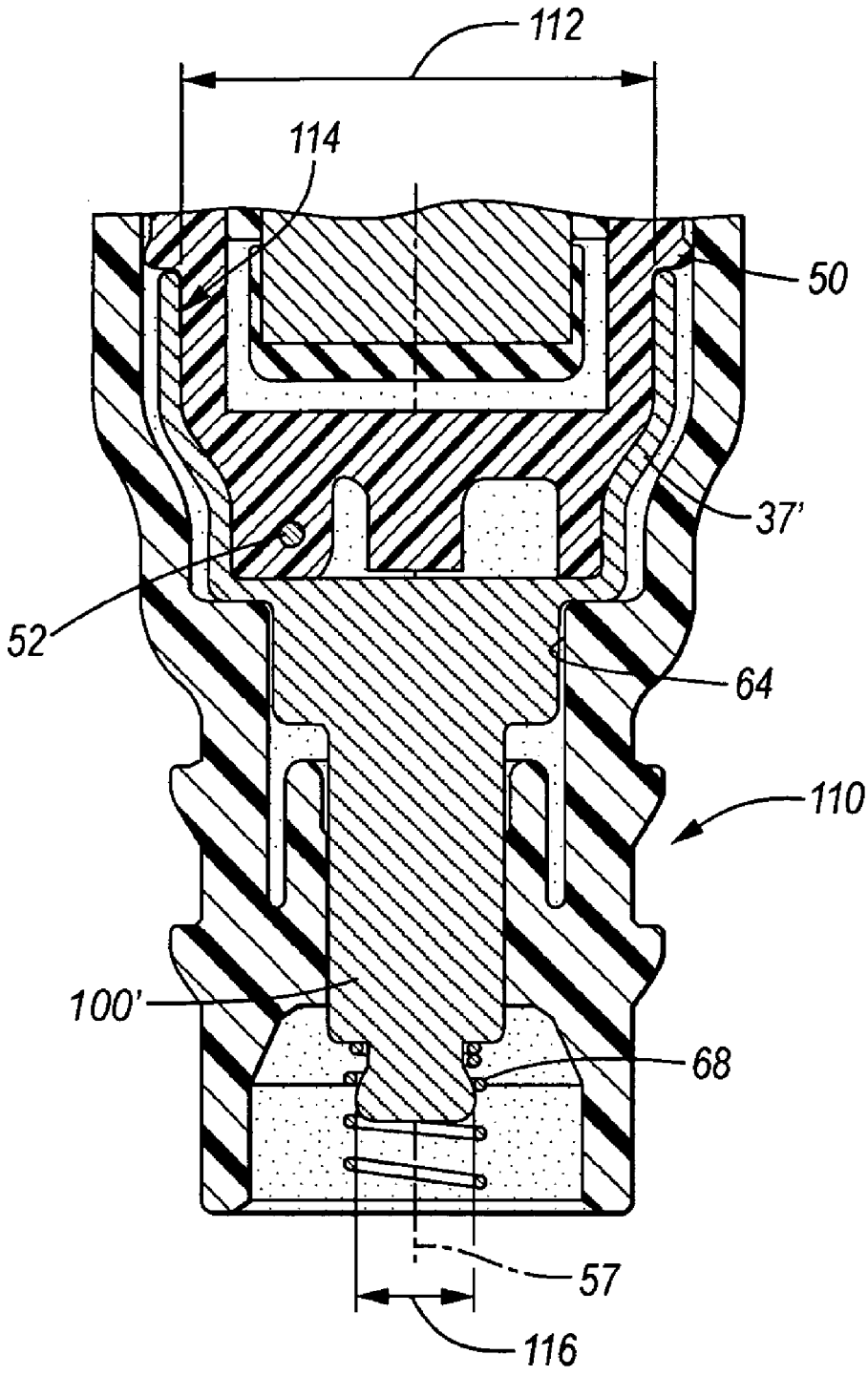
FIG. 5 is a simplified cross-sectional view showing a unitary cup and resistive element in accordance with a second embodiment of the invention.

FIG. 5 is a simplified cross-sectional view of a second embodiment of the present inventions showing an element 110. Element 110 includes a cup portion 37' and a resistive element portion 100', and is unitary in construction The element 110 may be made of the same material as element 100, as described above. Element 110 may also be formed by the same process (e.g., injection molding as element 100). The cup portion 37' includes an opening 114 with a diameter 112 configured in size to fit over spool 28, and to contact HV terminal 52 on an inside surface thereof (just like that shown in FIG. 3 for cup 37). This second embodiment provides the following advantages over the conventional art: (i) reducing even further the number of components required to mate the spark voltage to spring 68, thus simplifying manufacturing by combining first cup 37, resistor 41 and second cup 43 (as in FIG. 1); and (ii) further reducing the amount of insulating resin (e.g., epoxy potting material) required by increasing the closed, displacing volume of element 110. These points reduce cost.

The embodiments of the present invention both simplify construction, as well as reduce cost. In addition, these advantages are achieved while also maintaining a reduced incidence of electric field concentration, such as achieved in U.S. Pat. No. 6,724,289. Further details concerning ignition apparatus 10 will now be set forth configured to enable one of ordinary skill to practice the present invention. It should be understood that portions of the following are exemplary only and not limiting in nature. Many other configurations are known to those of ordinary skill in the art and are consistent with the teachings of the present invention.

Referring to FIG. 1, central core 16 may be elongated, having a main, longitudinal axis "A" associated therewith. Core 16 includes an upper, first end 42, and a lower, second end 44. Core 16 may be a conventional core known to those of ordinary skill in the art. As illustrated, core 16, in the preferred embodiment, takes a generally cylindrical shape (which is a generally circular shape in radial cross-section), and may comprise compression molded insulated iron particles or laminated steel plates, both as known.

Magnets 18 and 20 may be optionally included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

A rubber buffer cup 46 may be included.

Module 22 may be configured to perform a switching function, such as connecting and disconnecting an end of primary winding to ground.

Primary winding 24 may be wound directly onto core 16 in a manner known in the art. Primary winding 24 includes first and second ends and is configured to carry a primary current $I_P$ for charging apparatus 10 upon control of ignition system 12 of module 22. Winding 24 may be implemented using known approaches and conventional materials. Although not shown, primary winding 24 may be wound on a primary winding spool (not shown) in certain circumstances (e.g., when steel laminations are used). In addition, winding 24 may be wound on an electrically insulating layer that is itself disposed directly on core 16.

Layers 26 and 32 comprise an encapsulant or insulating resin suitable for providing electrical insulation within ignition apparatus 10. In a preferred embodiment, the encapsulant comprises epoxy potting material. The epoxy potting material introduced in layers 26 and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L" in FIG. 1. In one embodiment, layer 26 may be between about 0.1 mm and 1.0 mm thick. Of course, a variety of other thicknesses are possible depending on flow characteristics and insulating characteristics of the encapsulant and the design of the coil 10. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. In addition to the features described above, spool 28 is further characterized as follows. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding) on an outer winding surface 47 thereof, between upper and lower flanges 48 and 50 ("winding bay"), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Features 48 and 50 may be further configured so as to engage an inner surface of case 34 to locate, align, and center the spool 28 in the cavity of case 34 and providing upper and lower defining features for a winding surface therebetween.

As described above, spool 28 has associated therewith an electrically conductive (i.e., metal) high-voltage (HV) terminal 52. The body of spool 28 at a lower end thereof is configured so as to be press-fit into the interior of cup 37 (i.e., the spool gate portion) in the first embodiment, or in the alternative, cup portion 37' in the second embodiment.

FIG. 1 also shows secondary winding 30 in cross-section. Secondary winding 30, as described above, is wound on spool 28, and includes a low voltage end and a high voltage end $\mathbf{30}_{HV}$. The low voltage end may be connected to ground by way of a ground connection through LV connector body 38 in a manner known to those of ordinary skill in the art. The high voltage end $\mathbf{30}_{HV}$ is connected to HV terminal 52 as shown in FIG. 2. Winding 30 may be implemented using conventional approaches and material known to those of ordinary skill in the art.

Case 34 includes an inner, generally enlarged cylindrical surface, an outer surface, a first annular shoulder, a flange, an upper through-bore, and a lower through bore.

The inner surface of case 34 is configured in size to receive and retain spool 28 which contains the core 16 and primary winding 24. The inner surface of case 34 may be slightly spaced from spool 28, particularly the annular features 48, 50 thereof (as shown), or may engage the features 48, 50.

Lower through-bore 64 (best shown in FIG. 4) is defined by an inner surface thereof configured in size and shape (i.e., generally cylindrical) to accommodate an outer surface of cup 37 (or cup portion 37' in the alternate embodiment of FIG. 5) at a lowermost portion thereof as described above. When the lowermost body portion of spool 28 is inserted in the lower bore containing cup 37 (or cup portion 37'), a portion of HV terminal $\mathbf{52}_2$ engages an inner surface thereof (also via a press fit).

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages an outer surface of case 34. The shield 36 preferably comprises electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may be grounded by way of an internal grounding strap, finger or the like (not shown) well know to those of ordinary skill in the art. Shield 36 may comprise multiple, individual sheets 36, as shown.

In the first embodiment of the invention (e.g., FIGS. 2, 3), cup 37 is made from metal, has a longitudinal axis associated therewith, and is generally annular in shape. Cup 37 further includes a base 58, and a first, generally annular side wall 59 extending therefrom in a first axial direction to a folded over (hemmed) edge 60 that defines an opening leading to an interior of the cup. The interior is configured to receive a lower longitudinal end of secondary winding spool 28. The lower end of spool 28 is configured to receive the high voltage terminal 52. The interior is defined, in-part, by an inner, generally annular surface of sidewall 59. The axial extent of sidewall 59 is such that it extends all the way up to flange 50 when cup 37 is placed on spool 28 (so that base 58 engages spool 28).

Cup 37 further includes a second annular side wall 61 extending from base 58 in a second axial direction opposite the first axial direction. Cup 37 includes an annular aperture 62 having a stop surface 63. Aperture 62 is configured in size and shape to receive the first, upper axial end of resistive element 100 in a press fit (interference fit). Fold 60 of cup 37 exhibits a relatively large radii, so as to maintain a reduced electric field concentration (i.e., eliminate sharp edges). In addition, since sidewall 59 extends up to flange 50, the cup surrounds the secondary winding 30 as it exits winding surface 47. Cup 37 may be formed out of aluminum, brass, or other suitable electrically conductive material.

Cup portion 37' of element 110 (FIG. 5), in the second embodiment, is generally the same as cup 37', except that it is integral with resistive element portion 100' and formed of conductive plastic material. In this regard, the nature of the curves and transitions may exhibit even somewhat larger radii than with cup 37.

Low voltage connector body 38 via module 22 is configured to, among other things, electrically connect the first and second ends of primary winding 24 to an energization source, such as, the energization circuitry (e.g., power source) included in ignition system 12. Connector body 38 is generally formed of electrical insulating material, but also includes a plurality of electrically conductive output terminals 66 (e.g., pins for ground, primary winding leads, etc.). Terminals 66 are coupled electrically, internally through connector body 38 to module 22 and other portions of apparatus 10, in a manner known to those of ordinary skill in the art.

HV connector assembly 40 is provided for establishing an electrical connection to spark plug 14. Assembly 40 may include a spring contact 68 or the like. Contact spring 68 is in turn configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

In an internal combustion engine environment, the present invention, in addition to reducing components and cost as noted above, can maintain the reduced electric field concentrations, with the known advantages of reducing product failures and lowering warranty return rates. These improvements are obtained by way of a substantial reduction or even elimination of case punch-through failures (i.e., dendrite growth through insulating resin material, through case material, to ground potential, namely, the outer core or shield). The reduced electric field concentration will also extend the service life of the ignition apparatus.

The invention claimed is:

1. An ignition apparatus comprising:

a central core having a main axis;

a primary winding;

a spool having a winding surface;

a spark voltage terminal;

a secondary winding wound on said winding surface and having a high voltage end thereof connected to said terminal;

a cup engaging said terminal configured to surround said terminal and said high voltage end of said secondary winding;

a resistive element formed of conductive plastic material having a predetermined electrical resistance, said resistive element having a first axial end extending from said cup and a second axial end opposite said first axial end, said second axial end being configured to electrically engage a high voltage connector assembly, said connector assembly being configured for connection to a spark plug.

2. The apparatus of claim 1 wherein said cup is formed of metal and includes an annular aperture configured to receive said first axial end of said resistive element.

3. The apparatus of claim 1 wherein said cup is formed of conductive plastic material and wherein said cup and said resistive element are unitary.

4. The apparatus of claim 2 wherein said resistive element is generally cylindrical in shape having a first diameter and a length, said predetermined resistance having a value that is a function of said first diameter and said length.

5. The apparatus of claim 4 wherein said first axial end of said resistive element is reduced in size relative to said main diameter, said first axial end configured for a press fit with said annular aperture of said cup.

6. The apparatus of claim 5 wherein the second axial end of said resistive element has a third diameter that is reduced relative to said first diameter to form a shoulder.

7. The apparatus of claim 2 wherein said resistive element includes a smooth outer surface.

8. The apparatus of claim 3 wherein said resistive element has a first diameter and a length, said predetermined resistance having a value that is a function of said first diameter and said length.

9. The apparatus of claim 8 wherein said cup includes an opening having a second diameter configured to fit over said secondary spool.

10. The apparatus of claim 9 wherein said second axial end of said resistive element has a third diameter that is reduced relative to said first diameter.

11. The apparatus of claim 3 wherein said cup and resistive element have a smooth outer surface.

12. The apparatus of claim 1 where said resistive element comprises a conductive plastic material selected from the group comprising PET, PBT and non-conductive nylon in mixture with a conductive nylon.

* * * * *